US006155237A

United States Patent [19]

Frank

[11] Patent Number: 6,155,237

[45] Date of Patent: Dec. 5, 2000

[54] FUEL-SUPPLY SYSTEM FOR SUPPLYING FUEL FOR AN INTERNAL COMBUSTION ENGINE

[75] Inventor: Kurt Frank, Schorndorf, Germany

[73] Assignee: Robert Bosch GmbH, Stuttgart, Germany

[21] Appl. No.: 09/247,693

[22] Filed: Feb. 10, 1999

[30] Foreign Application Priority Data

Feb. 17, 1998 [DE] Germany ..... 198 06 412

[51] Int. Cl.[7] ..... F02M 37/04

[52] U.S. Cl. ..... 123/509; 123/497

[58] Field of Search ..... 123/509, 516, 123/495, 497, 510–11

[56] References Cited

U.S. PATENT DOCUMENTS

| | | | |
|---|---|---|---|
| 4,747,388 | 5/1988 | Tuckey | 123/510 |
| 4,807,582 | 2/1989 | Tuckey | 123/514 |
| 4,960,088 | 10/1990 | Havemann et al. | 123/198 D |
| 5,170,764 | 12/1992 | Tuckey | 123/509 |
| 5,363,827 | 11/1994 | Siekmann | 123/509 |
| 5,415,146 | 5/1995 | Tuckey | 123/509 |
| 5,560,342 | 10/1996 | Fournier et al. | 123/509 |
| 5,647,329 | 7/1997 | Bucci et al. | 123/509 |
| 5,724,947 | 3/1998 | Takaki et al. | 123/509 |
| 5,769,061 | 6/1998 | Nagata et al. | 123/509 |
| 6,002,328 | 12/1999 | Wallrafen | 340/450.2 |

FOREIGN PATENT DOCUMENTS

| | | |
|---|---|---|
| 2 640 556 | 6/1990 | France . |
| 2 750 456 | 1/1998 | France . |
| 1 97 10 299 | 1/1998 | Germany . |
| 02191861 | 7/1990 | Japan . |

*Primary Examiner*—Thomas N. Moulis
*Attorney, Agent, or Firm*—Kenyon & Kenyon

[57] ABSTRACT

A fuel-supply system for supplying fuel for an internal combustion engine, having a fuel pump which delivers fuel from a fuel tank. The fuel-supply system assures proper operation of the internal combustion engine, even when the fuel tank is nearly empty and in curves. The fuel-supply system includes a fuel pump connected to a fuel reservoir and to a control device which controls the fuel pump in such a way that the fuel pump delivers a cornering reserve into the fuel reservoir.

3 Claims, 3 Drawing Sheets

FUEL-SUPPLY SYSTEM FOR SUPPLYING FUEL FOR AN INTERNAL COMBUSTION ENGINE

FIELD OF THE INVENTION

The present invention relates to a fuel-supply system for supplying fuel for an internal combustion engine, having a fuel pump which delivers fuel from a fuel tank.

BACKGROUND INFORMATION

Nowadays, the fuel pump of such a fuel-supply system is often built into the fuel tank of a motor vehicle. In this case, particularly in curves and when the fuel tank is running almost empty, the fuel in the fuel tank can slosh back and forth, and the fuel pump is unable to suck in fuel for a brief time. As a result, the pressure in the fuel-supply system breaks down, which has a negative effect on the vehicle performance.

To avoid these disadvantages, it has been suggested to mount a "splash container" around the fuel pump on the intake side. The splash container is used as a fuel reservoir and, for example, is actively filled by a sucking jet pump. This design approach requires too much costly constructional outlay.

SUMMARY OF THE INVENTION

An object of the present invention is to provide a fuel-supply system which, in a simple manner, assures proper operation of the internal combustion engine, even when the fuel tank is nearly empty and in curves.

According to the present invention, a fuel-supply system is provided for supplying fuel for an internal combustion engine, having a fuel pump which delivers fuel from a fuel tank.

The fuel pump is connected to a fuel reservoir and is coupled to a control device which controls the fuel pump in such a way that the fuel pump delivers a cornering reserve into the fuel reservoir. By using a fuel-reservoir control, as is described, for example, in the previously proposed system described in German Published Patent Application No. 1 97 10 299, the "cornering reserve" can be implemented without additional design expenditure.

Another embodiment of the present invention provides a monitoring device, which monitors the level of fuel in the fuel tank and is coupled to the control device. In addition to the load state of the fuel reservoir, the level of fuel in the fuel tank is used as a further control variable, and, with an increasing emptying of the fuel tank, the fuel pump is switched on cyclically before the fuel reservoir is empty. The monitoring device passes on the prevailing fuel level in the fuel tank to the control device. When the fuel falls below a critical level, the control device is able to react accordingly. Given a nearly empty tank, first switching on the fuel pump when the fuel reservoir is empty could result in no fuel being available precisely when the fuel pump is switched on. According to the present invention, the fuel pump is already switched on before the fuel reservoir is empty. This ensures in a simple manner that the cornering reserve is always contained in the fuel reservoir, and thus is available on the high-pressure side of the fuel pump. At the same time, the volume of cornering reserve depends, inter alia, upon the size and shape of the fuel tank.

According to another embodiment of the present invention, the volume of the fuel reservoir is equal to a maximum cornering reserve, and the fuel pump is operated continuously, as soon as the level of fuel in the fuel tank falls below a specific limiting value. This design approach has the advantage that the fuel reservoir does not have to be larger than absolutely necessary in order to assure a sufficient fuel supply for the internal combustion engine, even in curves.

In a further embodiment of the present invention, the volume of the fuel reservoir is somewhat greater than a maximum cornering reserve. This has the advantage that overstressing of the fuel pump is avoided in extended curves.

DETAILED DESCRIPTION

Figure 1:
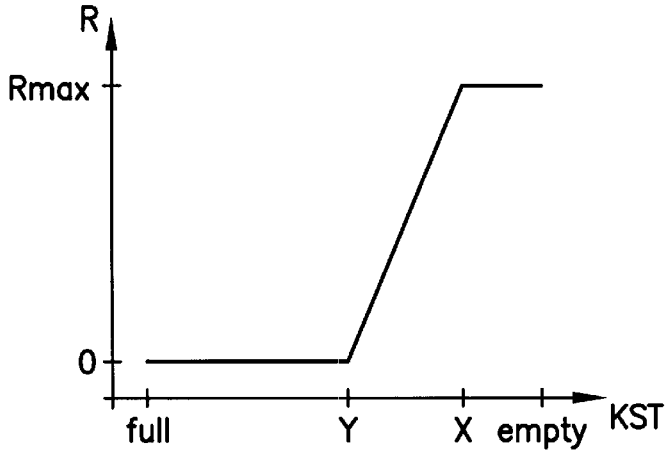
FIG. 1 shows a diagram according to the present invention that illustrates the necessary cornering reserve as a function of the fuel level in the fuel tank.

FIG. 1 shows the necessary cornering reserve R, ascertained by vehicle measurements, as a function of the fuel level in fuel tank KST. It follows from FIG. 1 that, given a full fuel tank KST, no cornering reserve is needed. Not until the fuel level in fuel tank KST reaches value Y can a back and forth sloshing of the fuel, as described above, have an unfavorable effect on the vehicle performance. Starting from value Y, the volume of necessary cornering reserve increases linearly. When the fuel level in fuel tank KST reaches value X, the maximum cornering reserve $R_{max}$ is needed to counteract the fluctuations of level in fuel tank KST. Maximum cornering reserve $R_{max}$ corresponds to a volume of approximately 0.5 liter.

Figure 2:
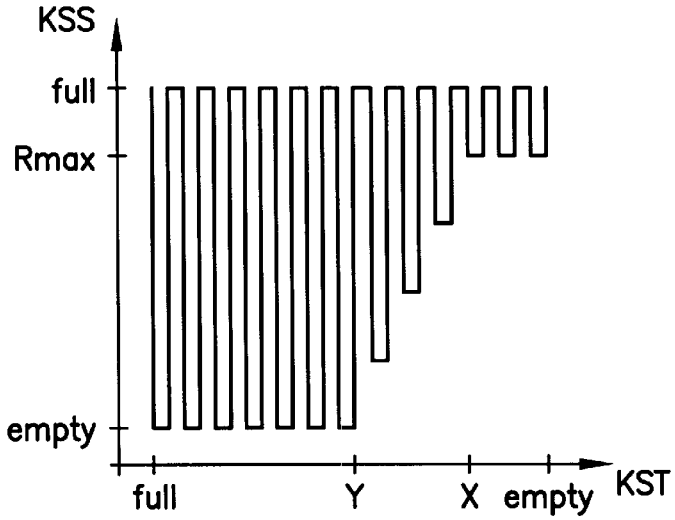
FIG. 2 shows a diagram according to the present invention that illustrates the fuel level in the fuel reservoir as a function of the fuel level in the fuel tank.

Following from the diagram shown in FIG. 1 is the setpoint curve, shown in FIG. 2, for the fuel level in a fuel reservoir KSS. Given a nearly full fuel tank KST, fuel reservoir KSS is filled cyclically, always when it is empty, by the fuel pump EKP with fuel from fuel tank KST. When the fuel level in fuel tank KST reaches value Y, fuel reservoir KSS is not first filled when it is empty, but rather already when a specific quantity of fuel is still contained in fuel reservoir KSS. The specific quantity of fuel corresponds to the necessary cornering reserve R (see also FIG. 1). As soon as the fuel level in fuel tank KST has reached value X, fuel reservoir KSS is always filled up again with fuel when only the maximum necessary cornering reserve $R_{max}$ is still contained in fuel reservoir KSS.

If fuel reservoir KSS is only able to accommodate the maximum necessary cornering reserve $R_{max}$, the result is that the fuel pump EKP must be operated continuously from point X, in order to ensure undisturbed vehicle performance in curves.

Figure 3:
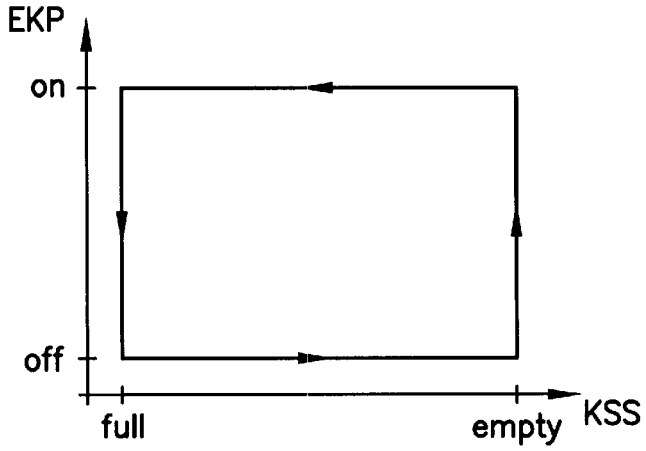
FIG. 3 shows a diagram according to the present invention that illustrates a switch-on cycle of the fuel pump as a function of a first fuel level in the fuel reservoir.

FIG. 3 shows the on-state of an electric fuel pump EKP as a function of the filling amount in fuel reservoir KSS. In the switched-on state, a supply voltage of 12 volts is applied to electric fuel pump EKP. In the switched-off state, the supply voltage has the value zero. The dependence shown in FIG. 3 is valid for fuel levels in fuel tank KST between "full" and "Y" (see FIGS. 1 and 2). As long as sufficient fuel is contained in fuel tank KST, no cornering reserve has to be retained in fuel reservoir KSS. Electric fuel pump EKP is always first switched on cyclically when fuel reservoir KSS is empty. Then electric fuel pump EKP remains switched on until fuel reservoir KSS is full. When fuel reservoir KSS is empty, the cycle repeats itself.

Figure 4:
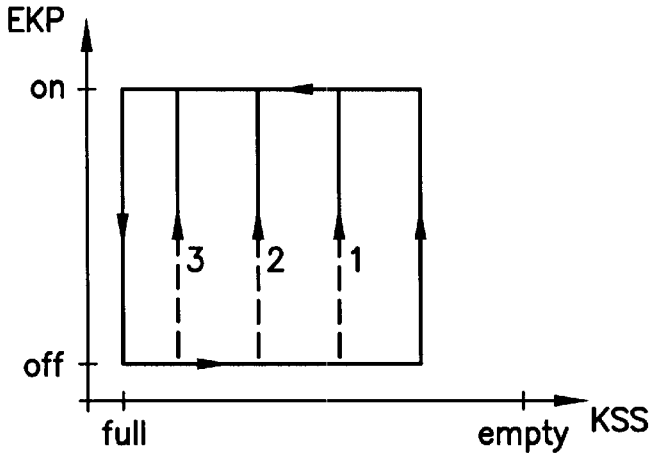
FIG. 4 shows a diagram according to the present invention that illustrates a switch-on cycle of the fuel pump as a function of a second fuel level in the fuel reservoir.

FIG. 4 shows the on-state of electric fuel pump EKP as a function of the filling amount in fuel reservoir KSS for fuel levels in fuel tank KST between "Y" and "X" (see FIGS. 1 and 2). The less fuel is contained in fuel tank KST, the more fuel is retained in fuel reservoir KSS as cornering reserve. This means that when a relatively large quantity of fuel is still contained in fuel tank KST, electric fuel pump EKP is switched on corresponding to arrow I in FIG. 4. When the level in fuel tank KST drops further, this is detected by a monitoring device, not shown, and transmitted to a control device. The control device then provides that, with the level of fuel dropping in fuel tank KST, the fuel quantity retained in fuel reservoir KSS increases. That is to say, electric fuel pump EKP is already switched on earlier, corresponding to arrows 2 and 3 in FIG. 4.

Figure 5:
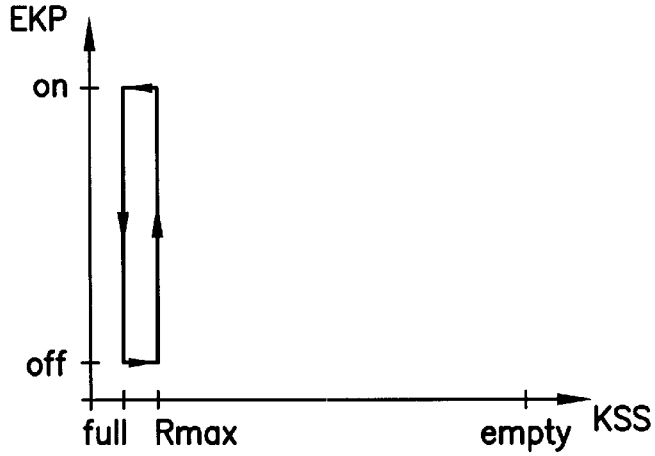
FIG. 5 shows a diagram according to the present invention that illustrates a switch-on cycle of the fuel pump as a function of a third fuel level in the fuel reservoir.

FIG. 5 shows the on-state of electric fuel pump EKP as a function of the filling amount in fuel reservoir KSS for fuel levels in fuel tank KST between "X" and "empty" (see FIGS. 1 and 2). In this state, the control device provides for maximum cornering reserve $R_{max}$ to be contained constantly in fuel reservoir KSS. This means that electric fuel pump EKP is always switched on when the level in fuel reservoir KSS reaches or falls below value $R_{max}$.

Figure 6:
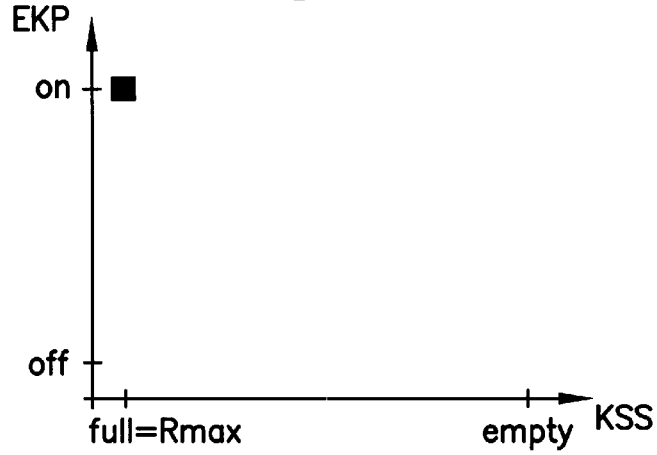
FIG. 6 shows a diagram according to the present invention that illustrates a switch-on cycle of the fuel pump as a function of a fourth fuel level in the fuel reservoir.

FIG. 6 shows the extreme case, in which the volume of fuel reservoir KSS corresponds to maximum cornering reserve $R_{max}$. In this extreme case, the control device provides for electric fuel pump EKP to remain switched on constantly until fuel tank KST is empty.

Figure 7:
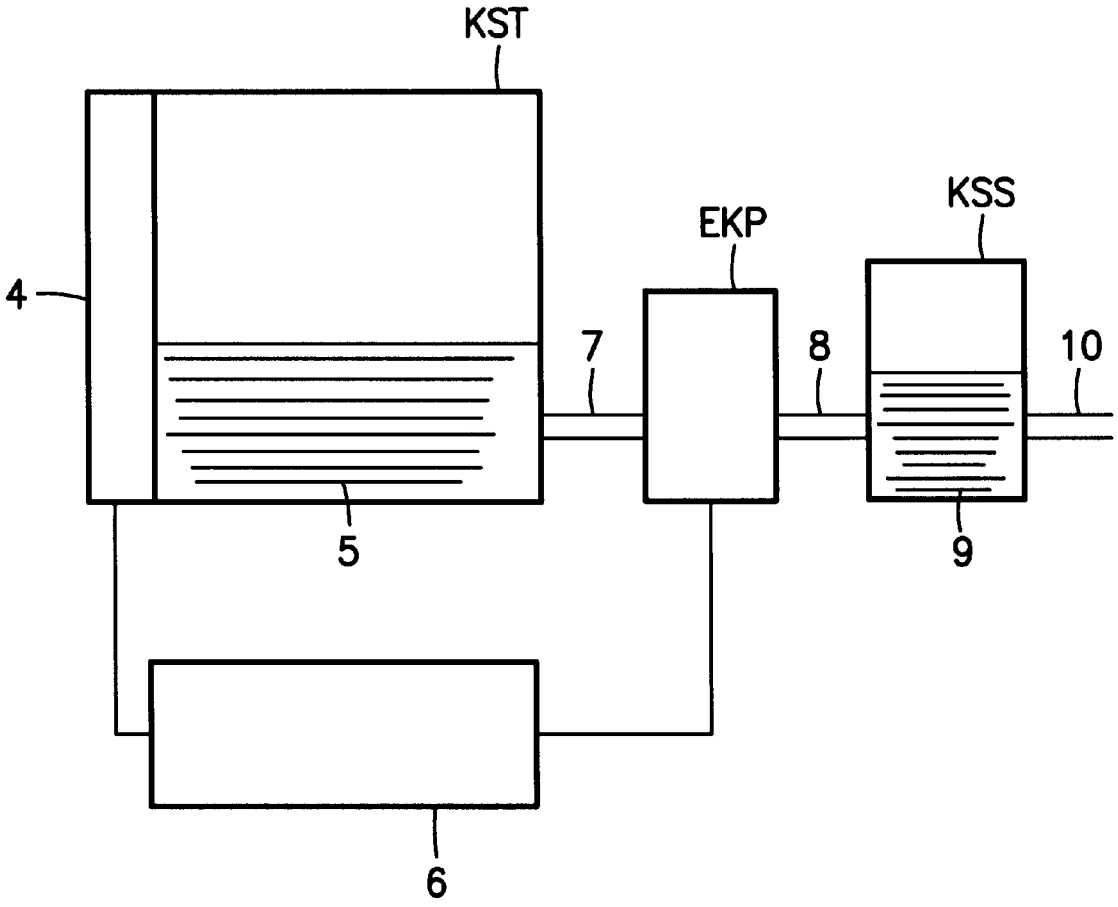
FIG. 7 shows an example of the fuel supply system of the present invention.

FIG. 7 shows the fuel tank KST with monitoring device 4 for monitoring a level of fuel 5 in the fuel tank KST. The monitoring device 4 is coupled to control device 6. The fuel tank KST is connected via pipe 7 to the electric fuel pump EKP which is connected via pipe 8 to the fuel reservoir KSS. The electric fuel pump EKP is controlled by the control device 6. Fuel 9 contained in the fuel reservoir KSS can be delivered via pipe 10 to an injection system of the internal combustion engine.

What is claimed is:

1. A fuel-supply system for supplying a fuel for an internal combustion engine, comprising:

a fuel tank;

a fuel reservoir;

a fuel pump coupled to the fuel tank and the fuel reservoir for delivering the fuel from the fuel tank to the fuel reservoir;

a monitoring device for monitoring a level of the fuel in the fuel tank; and a control device coupled to the monitoring device and controlling th e fuel pump such that the fuel pump delivers a cornering reserve into the fuel reservoir;

wherein the level of the fuel in the fuel tank a nd a load state of the fuel reservoir each corresponds to a respective control variable, and as the fuel level in the fuel tank decreases, the fuel pump is switched on cyclically before the fuel reservoir becomes empty.

2. The fuel-supply system according to claim 1, wherein:

a volume of the fuel reservoir is equal to a maximum cornering reserve, and as soon as the level of the fuel in the fuel tank falls below a specific limiting value, the fuel pump is operated continuously.

3. The fuel-supply system according to claim 1, wherein a volume of the fuel reservoir is greater than a maximum cornering reserve.

* * * * *